US005775344A

United States Patent [19]

Clay

[11] Patent Number: 5,775,344

[45] Date of Patent: Jul. 7, 1998

[54] COSMETIC CONTAINER AND APPLICATOR WITH HEATING APPARATUS

[76] Inventor: Mary A. Clay, 2770 E. Uintah St., Apt. 305, Colorado Springs, Colo. 80909

[21] Appl. No.: 598,901

[22] Filed: Feb. 9, 1996

[51] Int. Cl.[6] ..... A45D 40/26

[52] U.S. Cl. ..... 132/218; 401/1; 401/129; 132/313; 132/317; 132/269

[58] Field of Search ..... 132/118, 218, 132/271, 313, 317, 289, 290, 217, 216; 401/1, 2, 129; 15/160, 184, 257.01, 257.05, 1; 220/4.24, 429, 468, 604; 128/24.1

[56] References Cited

U.S. PATENT DOCUMENTS

| | | | |
|---|---|---|---|
| 364,691 | 6/1887 | Wallace | 401/1 |
| 2,630,516 | 3/1953 | Rausch et al. | 132/217 |
| 3,469,928 | 9/1969 | Widegren | 401/122 |
| 3,692,417 | 9/1972 | Aston | 401/122 |
| 3,822,434 | 7/1974 | Mahoney | 15/160 |
| 3,870,186 | 3/1975 | Reinhard | 220/212 |
| 3,896,823 | 7/1975 | Spatz | 132/88.7 |
| 4,291,685 | 9/1981 | Taelman | 128/24.1 |
| 4,403,624 | 9/1983 | Montgomery | 132/88.7 |
| 4,886,387 | 12/1989 | Goldberg | 401/122 |
| 4,913,172 | 4/1990 | Chou | 401/1 |
| 4,987,911 | 1/1991 | Powers | 132/320 |
| 5,054,946 | 10/1991 | Morel | 401/129 |

FOREIGN PATENT DOCUMENTS

| | | | |
|---|---|---|---|
| 622876 | 5/1949 | United Kingdom | 132/217 |

*Primary Examiner*—Todd E. Manahan
*Assistant Examiner*—E. Robert
*Attorney, Agent, or Firm*—Phillip A. Rein

[57] ABSTRACT

A closed cosmetic container (10) including a base cosmetic container (10B) having an applicator cap (10A-1) mounted thereon, a rod and brush assembly (10A) comprising a heat facilitating strip (90) located in the interior of an applicator rod (10A-2), and a heat facilitating strip (40) located between an interior wall (45) and an exterior wall (20) of the base cosmetic container (10B). With the cosmetic container (10) closed, that is with the applicator cap (10A-1), rod and brush assembly (10A) secured in place on top of the base cosmetic container (10B), and with the heat facilitating strips (90 & 40) activated, a heatable 10 cosmetic substance (150) inside a cosmetic holding area (55) of the base cosmetic container (10B) blends together dissolving any clogged or hardened cosmetic material. Once the applicator cap (10A-1) and the rod and brush assembly (10A) are removed from the base cosmetic container (10B), the heat facilitating strip (90) serves as a warming apparatus to keep the cosmetic substance (150) that remains on a brush (100) fluid and pliable while in use. The heat on the brush (100) increases the makeup's adherence to the user's eyebrows during single or repeated applications. This allows the user more time to apply additional uniform coats of makeup if desired. A wiper (50) is provided to remove excess cosmetic substance (150) from the brush (100) every time it is removed from the cosmetic holding area (55) of the base cosmetic container (10B). On/off switches (30 & 70) control respective operation of the heat facilitating strips (90 & 40).

10 Claims, 5 Drawing Sheets

COSMETIC CONTAINER AND APPLICATOR WITH HEATING APPARATUS

BACKGROUND

1. Field of Invention

This invention concerns a cosmetic container, applicator and pencil with a heating apparatus that prevents makeup such as mascara or liquid eyeliner from prematurely hardening and clogging during repeated use.

2. Description of Prior Art

Cosmetic products such as mascara and liquid eyeliner are stored in paste or fluid form in closed containers at room temperature. The product remains in this condition until it is exposed to air. One consequence of exposure to air is that during immediate use the user has a certain amount of time in which to apply additional coats of makeup before it starts to harden. Another consequence is that with continued use, the makeup tend s to build, clog, and harden on the applicator rod, brush and inside the cosmetic container.

Present day cosmetic containers address problems of build up and clogging by removing the clogged or built up cosmetic material from the applicator rod and brush through a wiper element which is typically located near the opening of the container at its top. As the applicator rod and brush is inserted and removed from the container, it rubs against the wiper element to remove residual makeup and makeup chunks. Cosmetic containers of this general type are depicted in U.S. Pat. Nos. 3,692,417 to Aston(Sep. 19, 1972), 3,870,186 to Reinhardt(Mar. 11, 1975), and 3,896,823 to Spatzs(Jun. 29, 1975). A number of structures having dual wipers for cleaning the applicator rod and removing excess makeup have also been suggested in the patent literature (e.g. U.S. Pat. Nos. 3,469,928 to Widegren(Sep. 30, 1969), 4,403,624 to Montgomery(Sep. 13, 1983), and 4,886,387 to Goldberg, Coram, Mavroudis, Hills, and Ferguson(Dec. 12, 1989).

Prior art cosmetic containers and applicators like the ones cited above solve the problems of build up, and clogging by employing some sort of wiper system to remove excess makeup and makeup chunks from the applicator rod and brush.

Even though the wiper system design is an improvement over prior commercial designs that had no wiper system for removing excess makeup from the applicator rod and brush, it still does not reduce or eliminate clogging that occurs when excess makeup or makeup chunks are re-deposited back inside the container by the wiper element. It is believed that the existing makeup inside the container gets further clogged and built up as more chunks accumulate over time subsequently reducing the amount of uncontaminated makeup available for use.

Another problem prior art cosmetic containers do not address is that once the container is opened and exposed to air, makeup existing in the container and on the brush assembly prematurely hardens and becomes less pliable during repeated applications.

OBJECTS OF INVENTION

Accordingly, several objects and advantages of my invention are:

- to prevent a makeup substance such as mascara or liquid eyeliner from prematurely hardening during a single or repeated application;
- to dissolve or eliminate any makeup chunks that may have been re-deposited back into container by the wiper element;

- to increase a makeup substance's pliability, adherence, and uniformity during a single or repeated application.

The aforementioned objects and advantages are achieved according to the invention in that there exists a heat facilitating strip located between the exterior and interior walls of the cosmetic container and within the wall of the applicator rod.

With the applicator rod and brush assembly inserted in a secure fashion on top of the container and the heat facilitating strip activated, a regulated level of heat is conveyed inside the container which increases the temperature therein. Concurrently, the temperature of the cosmetic substance existing inside the closed container rises. This enables the cosmetic substance to blend together and dissolve or eliminate any chunked makeup parts.

The heat produced by the applicator rod, after it is removed from the container serves to keep the cosmetic substance that remains on the rod and brush pliable and uniform during application. This allows the user more time in which to apply additional coats of the makeup.

A preferred embodiment of the present invention comprises: a) a container with an open end at its top and a closed end at its bottom; b) a protective exterior layer that forms the outermost wall of the container; c) an interior wall that forms a reservoir for holding a heatable cosmetic substance; d) a heat facilitating strip located between the exterior and interior walls; e) a battery located in a space between the exterior and interior walls down in the bottom closed end of the container connected to the heat facilitating strip; f) a temperature resistant wiper element attached to the interior wall of the reservoir near the container's top open end; g) an on/off switch located on the exterior side of the container connected to the aforementioned battery; h) an applicator cap, rod and brush assembly comprising a cap located on its top end, a brush at its bottom and an elongated rod that is attached to the brush and extends longitudinally upward from the brush until it connects to the cap; i) the aforementioned applicator rod comprises a heat facilitating strip located in the interior of the rod, extending its full length; j) the aforementioned applicator cap comprises a closed end at its top and an opened end at its bottom with a battery located in the closed end of the cap attached to the heat facilitating strip within the applicator rod; and k) an on/off switch located on the exterior side of the top closed end of the cap connected to the battery.

The cosmetic container and applicator cap, rod, and brush assembly aforementionally described essentially operates as a heating unit capable of increasing the temperature inside the container and of the cosmetic substance itself.

With the container closed, that is with the applicator cap, rod and brush assembly secured in place on top of the container, and the heat facilitating strip activated, the cosmetic substance inside the closed container blends together dissolving any clogged or hardened cosmetic material.

Once the applicator cap, rod and brush assembly is removed from the container, it serves as a warming apparatus to keep the cosmetic substance that remains on the brush fluid and pliable while in use. The heat on the brush increases the makeup's adherence to the eyelashes during single or repeated applications. This allows the user more time to apply additional uniform coats of makeup if desired. The temperature resistant wiper element serves to remove any excess makeup from the applicator rod and brush when it is removed or inserted into the container.

BRIEF DESCRIPTION OF THE DRAWINGS

FIG. 5 also shows a heat facilitating strip located between the exterior and interior walls of the container. Drawing Reference Numerals 10 closed cosmetic container 10A applicator cap, rod, brush assembly 10A-1 applicator cap 10A-2 applicator rod 10 cosmetic container base unit 20 insulated exterior wall of 10B 30 on/off switch of 10B 32 connector of 30 and 60 40 heat facilitating strip of 10B 45 interior wall of 10B 50 temperature resistant wiper element 55 cosmetic holding area of 10B 60 battery of 10B 67 connector of 70 and 80 70 on/off switch of 10A 80 battery of 10A 90 heat facilitating strip of 10A 100 brush with bristles of 10A-2 110 brush without bristles of 10A-2 115 liquid eyeliner pencil 117 applicator cap of 115 120 on/off switch of 115 122 connector of 120 and 130 130 battery of 115 140 heat facilitating strip of 115 142 interior wall of 115 145 insulated exterior wall of 115 147 cosmetic holding area of 115 150 heatable cosmetic substance 160 end tip applicator of 115 170 external heat case jacket 175 on/off switch of 170 180 insulated exterior wall of 170 185 interior wall of 170 190 battery of 170 200 heat facilitating strip of 170 205 connector of 175 and 190 225 cosmetic container with mascara 240 cap of 300 250 heat facilitating strip of 300 260 protective exterior wall of 300 270 interior wall of 300 273 holding area for heatable substance 275 heatable body lotion 280 on/off switch of 300 285 connector of 280 and 290 290 battery of 300 300 toiletry container

DESCRIPTION—FIGS. 1 to 5

Figure 1:
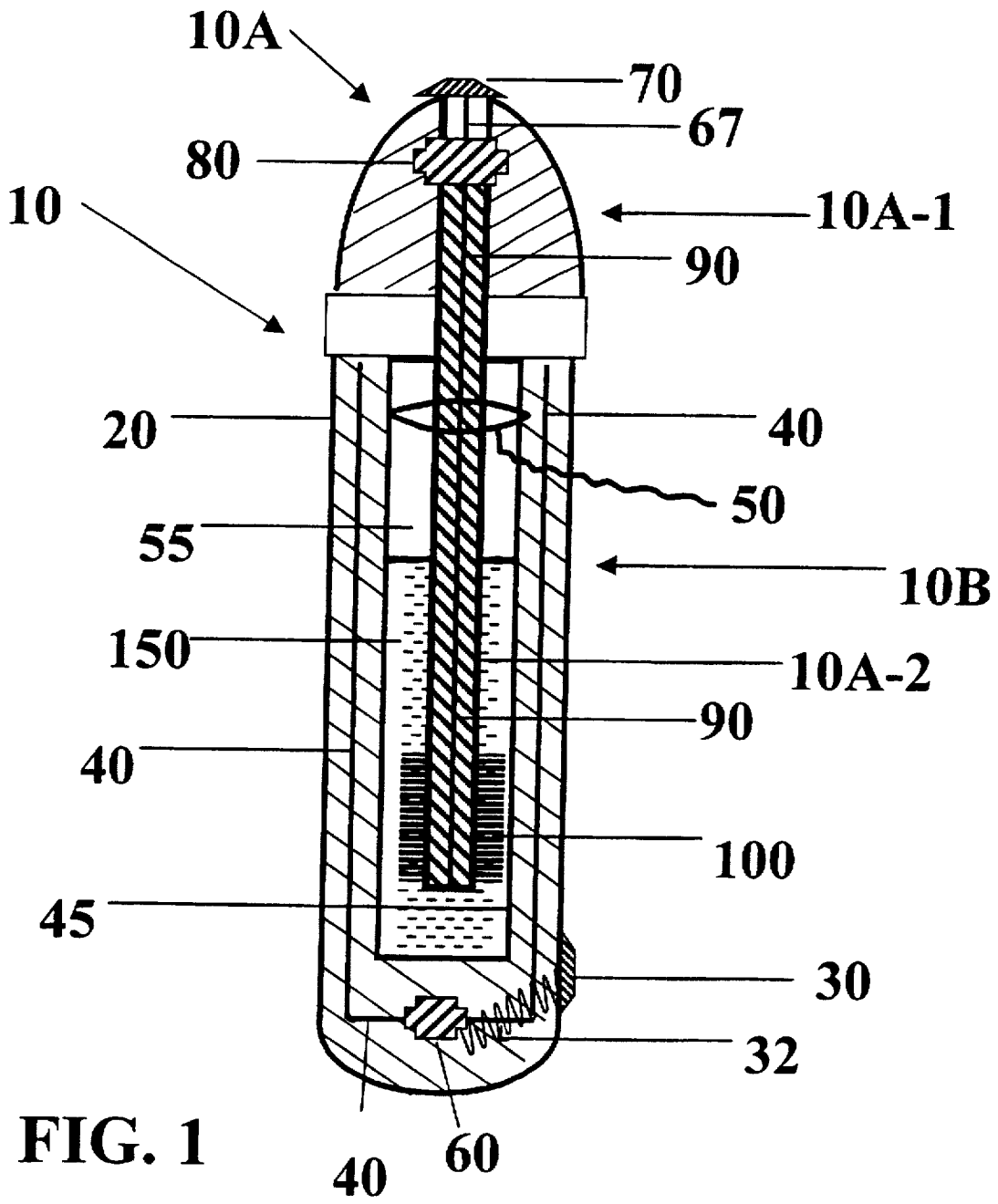
FIG. 1 shows a longitudinal interior view of a closed cosmetic container with a heat facilitating strip located between its exterior and interior walls. An applicator rod and brush assembly is also shown with a heat facilitating strip located within the interior wall of the applicator rod.

FIG. 1 shows a longitudinal interior view of a closed cosmetic container 10. An exterior insulated wall 20 of base container 10B has an on/off switch 30 located on its side. On/off switch 30 is connected to a battery 60 by way of a connector 32. A heat facilitating strip 40 is connected directly to battery 60. The space inside an interior wall 45 represents an area 55 for holding a heatable cosmetic substance 150. A temperature resistant wiper element 50 is connected to interior wall 45. FIG. 1 also shows an interior longitudinal view of an applicator cap, rod and brush assembly 10A inserted inside cosmetic container 10B. Battery 80 is housed in the interior of an applicator cap 10A-1 and is connected to an on/off switch 70 by way of connector 67. A heat facilitating strip 90 is attached directly to battery 80 and extends downward from battery 80 through the interior of an applicator rod 10A-2. An applicator brush 100 is attached on the exterior of rod 10A-2 at its bottom end.

Figure 2:
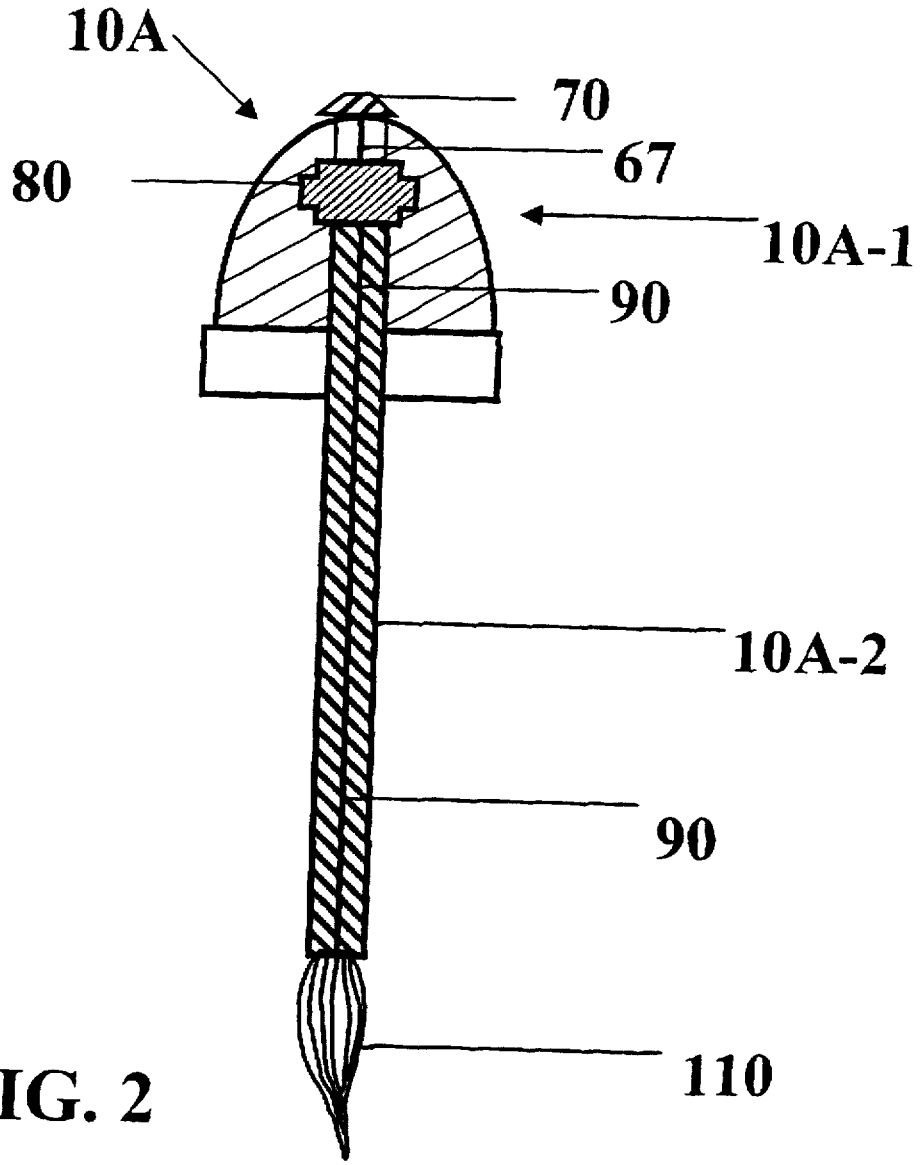
FIG. 2 shows another embodiment of the applicator brush assembly shown in FIG. 1. This drawing shows a longitudinal interior view of a cap, rod and brush assembly without bristles.

The applicator cap, rod and brush assembly 10A shown in FIG. 1 is the same as the one shown in FIG. 2 except the cap, rod, and brush assembly is not inside container 10B and the applicator brush 100 is without bristles 110.

Figure 3:
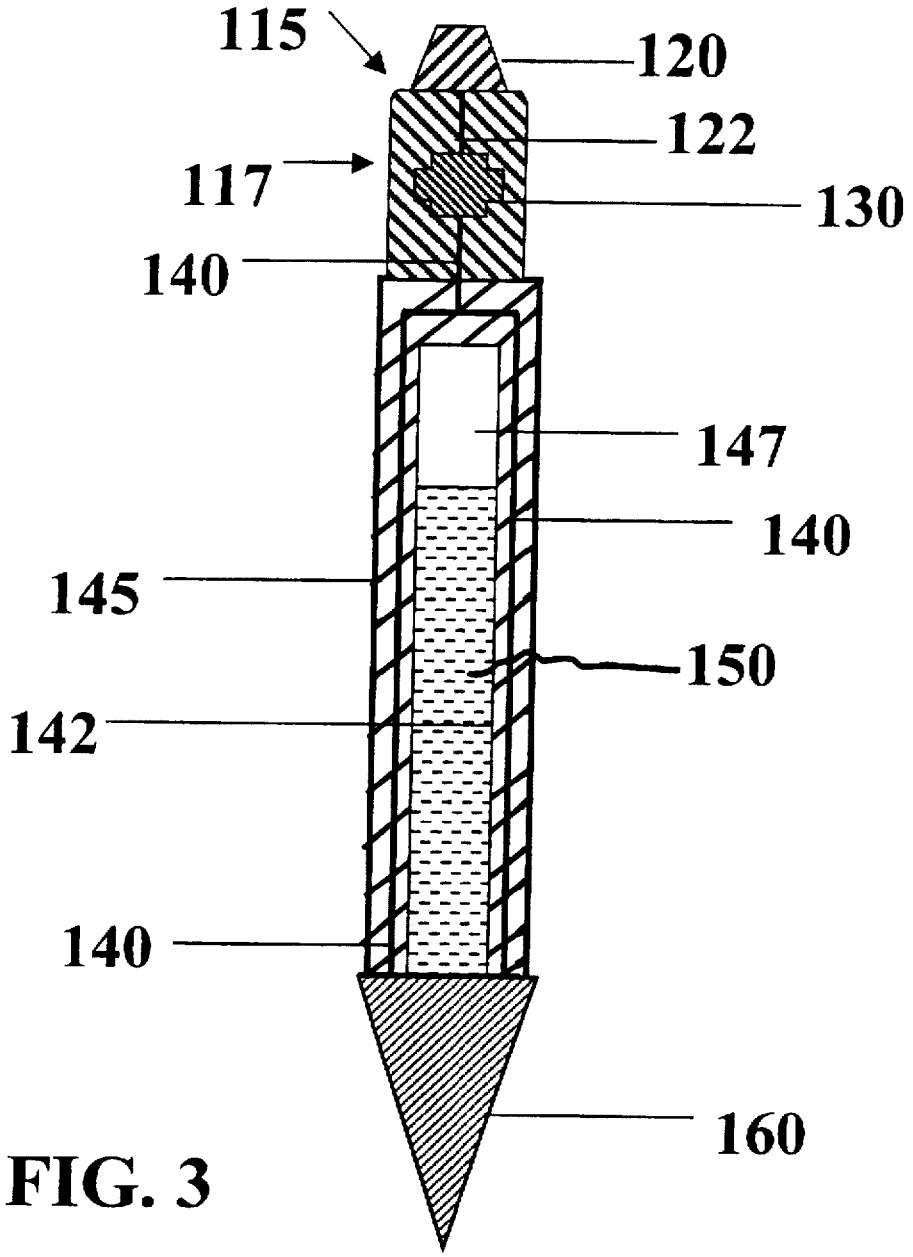
FIG. 3 shows a longitudinal interior view of a liquid eyeliner pencil with a heat facilitating strip located between the interior wall and exterior wall of the pencil case.

FIG. 3 shows a longitudinal interior view of a liquid eyeliner pencil 115. A battery 130 is housed in the interior of an applicator cap 117 and is connected to an on/off switch 120 by way of a connector 122. Battery 130 is attached directly to a heat facilitating strip 140. Heat facilitating strip 140 is housed between an insulated exterior wall 145 and an interior wall 142 and extends downward between both walls (142 and 145) until it reaches a end tip applicator 160. A heatable cosmetic substance 150 is located inside cosmetic holding area 147.

Figure 4:
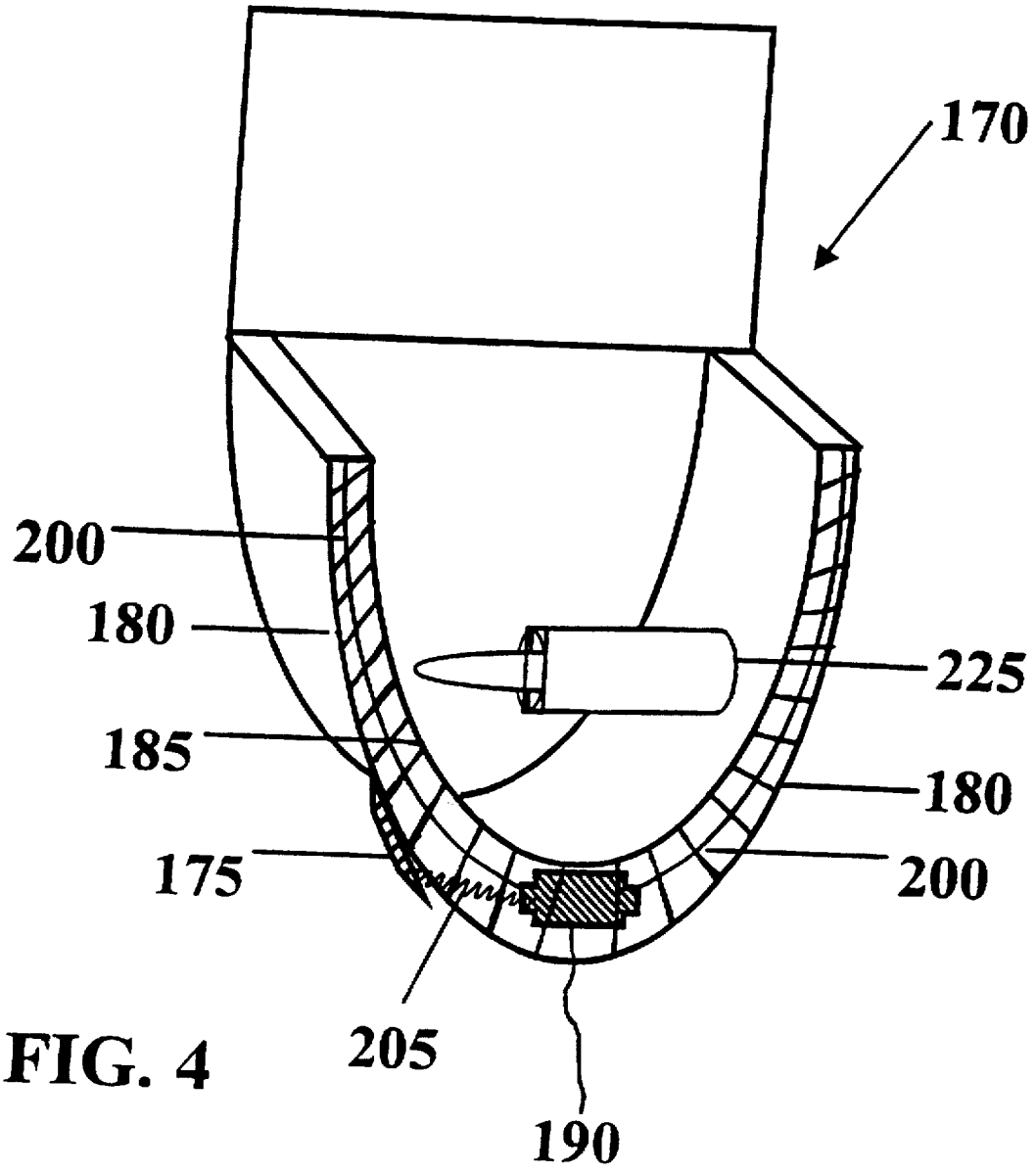
FIG. 4 shows an interior view of an external heat case jacket with a heat facilitating strip located between its internal and external walls. A present day mascara product is also shown inserted inside the jacket.

FIG. 4 shows an interior view of an external heat case jacket 170 with a cosmetic container filled with mascara 225 placed inside the jacket. An on/off switch 175 is connected to a battery 190 by way of a connector 205. Battery 190 is located in the interior bottom end of case 170. Battery 190 is attached directly to a heat facilitating strip 200. Heat facilitating strip 200 is housed between an insulated exterior wall 180 and an interior wall 185.

Figure 5:
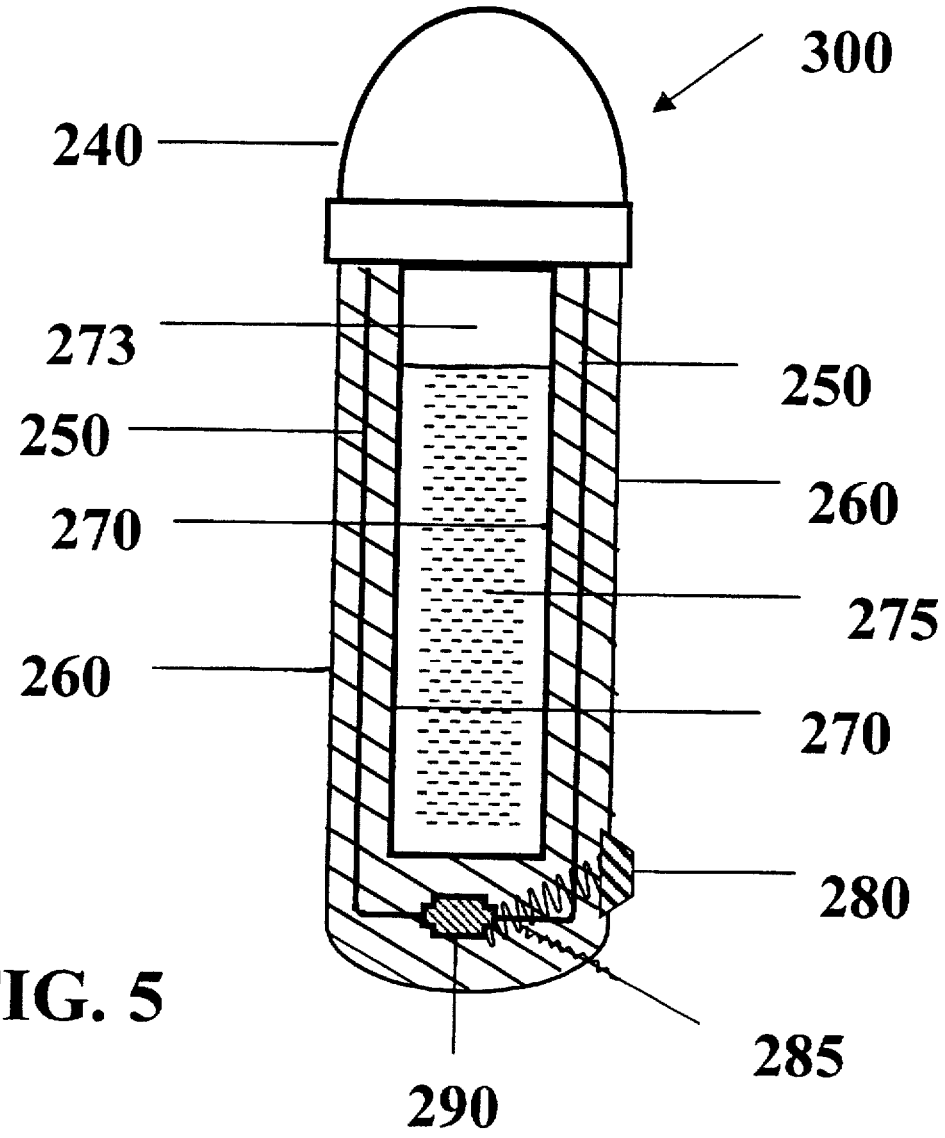
FIG. 5 shows a longitudinal interior view of a container for a heatable toiletry substance such as shaving cream or body lotion.

FIG. 5 shows a longitudinal interior view of a closed toiletry container 300 for a heatable toiletry substance such as a body lotion 275. The protective exterior wall 260 has an on/off switch 280 located on its side. On/off switch 280 is connected to a battery 290 by way of a connector 285. A heat facilitating strip 250 is connected directly to battery 290. The space inside an interior wall 270 represents a holding area 273 for a heatable toiletry substance. A Cap 240 is used to seal container 300 when the heat facilitating strip 250 is activated and when the container is not being used.

OPERATION—FIGS. 1 to 5

Generally speaking, in closed cosmetic container 10 of FIG. 1, when on/off switch 70 (located on top of applicator cap 10A-1) is turned on, connector 67 activates battery 80 to produce a regulated level of heat through the heat facilitating strip 90. Heat from the facilitating strip passes through the wall of applicator rod 10A-2 simultaneously increasing the temperature inside the container's area 55 and of heatable cosmetic substance 150. Likewise, when on/off switch 30 (located on the exterior side of base container 10B) is turned on, connector 32 activates battery 60 to produce a regulated level of heat through heat facilitating strip 40. Heat from the facilitating strip passes through interior wall 45 further increasing the temperature inside area 55 and of heatable cosmetic substance 150.

The insulated exterior wall 20 prevents heat from escaping and permeating to the outside of container 10B. The closed container 10 with its insulated exterior wall 20 also prevents heatable cosmetic substance 150 from evaporating. The increased regulated temperature inside the container allows cosmetic substance 150 to blend together and dissolve any clogged or chunked cosmetic parts.

When applicator cap, rod, and brush assembly 10A is removed from container 10B it passes against wiper element 50 to remove any excess cosmetic substance 150. Applicator rod 10A-2 can continue to generate heat during use so that cosmetic substance 150 remains warm and pliable on brush 100, allowing additional coats of cosmetic substance 150 to be applied if desired.

In FIG. 2, on/off switch 70, connector 67, battery 80, heat facilitating strip 90, applicator cap 10A-1, applicator rod 10A-2 and brush assembly 110 of the applicator cap, rod and brush assembly 10A operate in the same manner as the identical named parts in FIG. 1 except the brush assembly 100 in FIG. 1 operates without bristles 110 in FIG. 2.

In FIG. 3 when on/off switch 120 is turned on, connector 122 activates battery 130 to produce a regulated level of heat through heat facilitating strip 140. Battery 130 is housed in applicator cap 117. Heat from the heat facilitating strip 140 passes through the interior wall 142, increasing the temperature inside area 147 and of heatable cosmetic substance 150. Insulated exterior wall 145 prevents heat from escaping and permeating to the outside of the eyeliner pencil 115. The increased regulated temperature inside area 147 allows cosmetic substance 150 to blend and dissolve any clogged, chunked or hardened cosmetic material. The end tip applicator 160 is not heated but becomes slightly warm when cosmetic substance 150 passes through the tip.

FIG. 4 shows an external heat case jacket 170 that operates as a heating unit for present day cosmetic containers of products such as mascara or liquid eyeliner that have no internal heat unit. When a typical mascara product 225 is placed inside jacket 170 and on/off switch 175 is turned on, connector 205 activates battery 190 to produce a regulated level of heat through heat facilitating strip 200. Regulated heat from the facilitating strip passes through internal wall 185 increasing the temperature inside jacket 170 and of the mascara product 225. As the temperature increases, the makeup blends together dissolving any clogged or chunked makeup parts. The external insulated wall 180 prevents the heat from escaping to the outside of the jacket.

Referring to FIG. 5 in a closed heatable toiletry container 300, when on/off switch 280 is turned on, connector 285 activates battery 290 to produce a regulated level of heat through the heat facilitating strip 250. Heat from the facilitating strip passes through interior wall 270 increasing the temperature inside area 273 and of body lotion substance 275. The protective exterior wall 260 and cap 240 prevent heat from escaping and permeating to the outside of container 300. The closed container 300 with its protective exterior wall 260 also prevents the body lotion substance 275 from evaporating. The increased regulated temperature inside the container allows the temperature of the body lotion to rise producing a warmed aesthetic quality during application.

SUMMARY, RAMIFICATIONS, AND SCOPE

The reader will see that the cosmetic container, applicator rod, brush assembly, and external heat case jacket of the invention provides the user with a more efficient way of eliminating cosmetic build up that may occur over time. In the long run, the user is actually left with more cosmetic substance to apply since any clogged or chunked makeup parts get dissolved and blended together with the existing uncontaminated makeup. Accordingly, The heat produced by the applicator rod, after it is removed from the container serves to keep the cosmetic substance pliable and uniform during single or repeated applications. This allows the user more time in which to apply additional coats of the makeup if desired.

The heatable toiletry container of the invention provides the user with a relatively quick and efficient method for applying warmed toiletry products such as body lotion, shaving cream or rubbing ointment to the body. The heated toiletry substance provides aesthetic and soothing qualities during application.

While my above description contain many specificities, these should not be construed as limitations on the scope of the invention, but rather as an exemplification of some preferred embodiments thereof Many other variation are possible. For example:

The invention can be constructed to have as little as one heat facilitating strip to warm the entire base container as well as the applicator rod and brush assembly.

The invention can be constructed to have one on/off switch to activate the battery in both the applicator cap and base container.

The invention can be constructed to have automatic shut off capability.

The invention can be constructed to have heat generated by chemical reaction or alternating current (A/C) instead of by battery (D/C).

The external heat jacket can be constructed to accommodate present day products such as heatable shaving cream, body lotion or rubbing ointment. These products and their containers can be placed directly inside the external heat jacket to warm their contents.

The applicator cap, rod, and brush assembly with its internal heat unit can be used as a stand alone apparatus to straighten and lengthen eyelashes without the use of makeup.

The applicator rod and brush assembly with its internal heat unit can be used exclusively as a re-shaping device to allow makeup that has been previously applied to the eyelashes to become pliable again for purposes of remolding and refreshening the existing makeup.

Accordingly, the scope of the invention should be determined not by the embodiments illustrated, but by the appended claims and their legal equivalents.

I claim:

1. A cosmetic container, comprising:

(a) a container having an opening at a top portion and a closed end at a bottom portion;

(b) a protective exterior layer that forms an outermost wall of said container;

(c) an interior wall that forms a reservoir protecting and holding a heatable cosmetic substance;

(d) a power supply to supply energy used to produce regulated heat in said container;

(e) a means for conveying a regulated temperature from said power supply to the reservoir to heat and melt said heatable cosmetic substance contained therein;

(f) a temperature resistant wiper element attached to said interior wall of said reservoir; and said conveying means mounted about said interior wall forming said reservoir.

2. A cosmetic container of claim 1 wherein an applicator rod and brush is releasably mounted in said reservoir to receive a melted portion of said heatable cosmetic substance thereon.

3. A cosmetic container of claim 2 wherein said temperature resistant wiper element is engaged with said applicator rod and brush to remove excess cosmetic material from a portion thereof.

4. A cosmetic container of claim 2 wherein said applicator rod and brush is secured in a closed fashion into said container in which said regulated temperature inside said container provides means for dissolving and blending said heatable cosmetic substance in said reservoir and on said rod and brush assembly.

5. A cosmetic applicator system, comprising:

(a) a cosmetic container including a base cosmetic container with a heatable cosmetic substance therein, a power supply, and an application cap, rod and brush assembly releasably sealingly engageable with said base cosmetic container;

(b) said applicator cap, rod and brush assembly includes an applicator cap connected to an applicator rod which, in turn, is connected to a brush secured to an outer end thereof;

(c) a means for conveying a regulated temperature from said power supply to an intermediate space around said applicator rod and said brush when said applicator cap, rod and brush assembly is mounted on said base cosmetic container and operable to heat said heatable cosmetic substance on said brush and in said base cosmetic container; and (d) said conveying means mounted about a reservoir in said base cosmetic container holding the cosmetic substance therein.

6. A cosmetic applicator system as described in claim 5, wherein:

(a) a second means in said applicator cap, rod and brush assembly for conveying a regulated temperature to said applicator rod and said brush and operable to heat said heatable cosmetic substance on said brush.

7. A cosmetic applicator system as described in claim 6, wherein:

(a) said means and said second means for conveying a regulated temperature are each independently energized and operable to selectively heat said intermediate space in said base cosmetic container, said applicator rod, and said brush.

8. A cosmetic applicator system as described in claim 6, wherein:

(a) said brush operable to be continuously heated when disengaged from said base cosmetic container so as to be used for modifying shape of a person's eyelashes during usage thereof.

9. A cosmetic applicator system used to apply a cosmetic substance, comprising:

(a) a cosmetic container base having a cosmetic holding area operable to receive a cosmetic substance therein;

(b) a heat facilitating member mounted in said cosmetic container base mounted about but separated from said cosmetic holding area and operable to provide heat to said cosmetic holding area to melt a cosmetic substance contained therein; and (c) an applicator cap, rod and brush assembly selectively and sealingly engageable with said cosmetic container base to prevent evaporation of said cosmetic substance in said cosmetic holding area;

(d) said applicator cap, rod and brush assembly includes a cap connected to support member having a cosmetic applicator connected to an outer end thereof;

(e) said cosmetic applicator selectively mounted in said cosmetic holding area to receive a portion of said cosmetic substance thereon when in a melted, heated condition due to energization of said heat facilitating member; and (f) said applicator cap, rod and brush assembly includes a heat facilitating element operable connected to said cosmetic applicator to maintain said cosmetic substance in heated fluid state when removed from said cosmetic container base.

10. A cosmetic applicator system as described in claim 9, wherein:

(a) said heat facilitating member and said heat facilitating element each having its own power supply and control member operable to selectively heat said cosmetic container base and/or said cosmetic applicator as deemed necessary.

* * * * *